US008215420B2

(12) United States Patent
Hall et al.

(10) Patent No.: US 8,215,420 B2
(45) Date of Patent: Jul. 10, 2012

(54) THERMALLY STABLE POINTED DIAMOND WITH INCREASED IMPACT RESISTANCE

(75) Inventors: David R. Hall, Provo, UT (US); Ronald B. Crockett, Payson, UT (US); Joe Fox, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 472 days.

(21) Appl. No.: 12/366,706

(22) Filed: Feb. 6, 2009

(65) Prior Publication Data

US 2009/0133938 A1 May 28, 2009

Related U.S. Application Data

(63) Continuation-in-part of application No. 12/051,738, filed on Mar. 19, 2008, now Pat. No. 7,669,674, which is a continuation of application No. 12/051,689, filed on Mar. 19, 2008, now Pat. No. 7,963,617, which is a continuation of application No. 12/051,586, filed on Mar. 19, 2008, now Pat. No. 8,007,050, which is a continuation-in-part of application No. 12/021,051, filed on Jan. 28, 2008, now Pat. No. 8,123,302, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, now Pat. No. 8,007,051, which is a continuation-in-part of application No. 11/844,586, filed on Aug. 24, 2007, now Pat. No. 7,600,823, which is a continuation-in-part of application No. 11/829,761, filed on Jul. 27, 2007, now Pat. No. 7,722,127, which is a continuation-in-part of application No. 11/773,271, filed on Jul. 3, 2007, now Pat. No. 7,997,661, which is a continuation-in-part of application No. 11/766,903, filed on Jun. 22, 2007, which is a continuation of application No. 11/766,865, filed on Jun. 22, 2007, which is a continuation-in-part (Continued)

(51) Int. Cl.
*E21B 10/46* (2006.01)

(52) U.S. Cl. ..... 175/433; 175/434; 299/111; 299/112 T

(58) Field of Classification Search ..... 175/433, 175/434; 299/111, 112
See application file for complete search history.

(56) References Cited

U.S. PATENT DOCUMENTS 465,103 A 12/1891 Wegner (Continued)

FOREIGN PATENT DOCUMENTS

DE 3 307 910 9/1984

(Continued)

OTHER PUBLICATIONS

International Search Report for Application No. PCT/US2007/075670, dated Nov. 17, 2008 (3 pages).

(Continued)

*Primary Examiner* — John Kreck
(74) *Attorney, Agent, or Firm* — Brinks Hofer Gilson & Lione

(57) ABSTRACT

An insert comprises a sintered polycrystalline diamond body bonded to a cemented metal carbide substrate. The diamond body comprises a substantially conical shape with conical side wall terminating at an apex. The diamond body comprises a first region with a metallic catalyst dispersed through interstices between the diamond grains and a second region proximate the apex with the characteristic of higher thermal stability than the first region.

11 Claims, 7 Drawing Sheets

Related U.S. Application Data of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, 2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, application No. 12/366,706, which is a continuation-in-part of application No. 11/673,634, filed on Feb. 12, 2007, now Pat. No. 8,109,349.

(56) References Cited

U.S. PATENT DOCUMENTS

| | | | |
|---|---|---|---|
| 616,118 | A | 12/1898 | Kunhe |
| 946,060 | A | 1/1910 | Looker |
| 1,116,154 | A | 11/1914 | Stowers |
| 1,183,630 | A | 5/1916 | Bryson |
| 1,189,560 | A | 7/1916 | Gondos |
| 1,360,908 | A | 11/1920 | Everson |
| 1,387,733 | A | 8/1921 | Midgett |
| 1,460,671 | A | 7/1923 | Hebsacker |
| 1,544,757 | A | 7/1925 | Hufford et al. |
| 1,821,474 | A | 9/1931 | Mercer |
| 1,879,177 | A | 9/1932 | Gault |
| 2,004,315 | A | 6/1935 | Fean |
| 2,054,255 | A | 9/1936 | Howard |
| 2,064,255 | A | 12/1936 | Garfield |
| 2,124,438 | A | 7/1938 | Struk et al. |
| 2,169,223 | A | 8/1939 | Christian |
| 2,218,130 | A | 10/1940 | Court |
| 2,320,136 | A | 5/1943 | Kammerer |
| 2,466,991 | A | 4/1949 | Kammerer |
| 2,540,464 | A | 2/1951 | Stokes |
| 2,544,036 | A | 3/1951 | Kammerer |
| 2,755,071 | A | 7/1956 | Kammerer |
| 2,776,819 | A | 1/1957 | Brown |
| 2,819,043 | A | 1/1958 | Henderson |
| 2,838,284 | A | 6/1958 | Austin |
| 2,894,722 | A | 7/1959 | Buttolph |
| 2,901,223 | A | 8/1959 | Scott |
| 2,963,102 | A | 12/1960 | Smith |
| 3,135,341 | A | 6/1964 | Ritter |
| 3,254,392 | A | 6/1966 | Novkov |
| 3,294,186 | A | 12/1966 | Buell |
| 3,301,339 | A | 1/1967 | Pennebaker, Jr. |
| 3,379,264 | A | 4/1968 | Cox |
| 3,397,012 | A | 8/1968 | Krekeler |
| 3,429,390 | A | 2/1969 | Bennett |
| 3,493,165 | A | 2/1970 | Schonfeld |
| 3,583,504 | A | 6/1971 | Aalund |
| 3,626,775 | A | 12/1971 | Gentry |
| 3,745,396 | A | 7/1973 | Quintal et al. |
| 3,745,623 | A | 7/1973 | Wentorf, Jr. et al. |
| 3,746,396 | A | 7/1973 | Radd |
| 3,764,493 | A | 10/1973 | Rosar et al. |
| 3,800,891 | A | 4/1974 | White et al. |
| 3,807,804 | A | 4/1974 | Kniff |
| 3,821,993 | A | 7/1974 | Kniff et al. |
| 3,830,321 | A | 8/1974 | McKenry et al. |
| 3,932,952 | A | 1/1976 | Helton |
| 3,945,681 | A | 3/1976 | White |
| 3,955,635 | A | 5/1976 | Skidmore |
| 3,960,223 | A | 6/1976 | Kleine |
| 4,005,914 | A | 2/1977 | Newman |
| 4,006,936 | A | 2/1977 | Crabiel |
| 4,081,042 | A | 3/1978 | Johnson et al. |
| 4,096,917 | A | 6/1978 | Harris |
| 4,098,362 | A | 7/1978 | Bonnice |
| 4,106,577 | A | 8/1978 | Summers |
| 4,109,737 | A | 8/1978 | Bovenkerk |
| 4,140,004 | A | 2/1979 | Smith et al. |
| 4,156,329 | A | 5/1979 | Daniels et al. |
| 4,176,723 | A | 12/1979 | Arceneaux |
| 4,199,035 | A | 4/1980 | Thompson |
| 4,201,421 | A | 5/1980 | Den Besten |
| 4,211,508 | A | 7/1980 | Dill et al. |
| 4,224,380 | A | 9/1980 | Bovenkerk et al. |
| 4,253,533 | A | 3/1981 | Baker, III |
| 4,268,089 | A | 5/1981 | Spence et al. |
| 4,277,106 | A | 7/1981 | Sahley |
| 4,280,573 | A | 7/1981 | Sudnishnikov et al. |
| 4,304,312 | A | 12/1981 | Larsson |
| 4,307,786 | A | 12/1981 | Evans |
| D264,217 | S | 5/1982 | Prause et al. |
| 4,333,902 | A | 6/1982 | Hara |
| 4,333,986 | A | 6/1982 | Tsuji et al. |
| 4,337,980 | A | 7/1982 | Krekeler |
| 4,390,992 | A | 6/1983 | Judd |
| 4,397,361 | A | 8/1983 | Langford, Jr. |
| 4,412,980 | A | 11/1983 | Tsuji et al. |
| 4,416,339 | A | 11/1983 | Baker et al. |
| 4,425,315 | A | 1/1984 | Tsuji et al. |
| 4,439,250 | A | 3/1984 | Acharya et al. |
| 4,445,580 | A | 5/1984 | Sahley |
| 4,448,269 | A | 5/1984 | Ishikawa et al. |
| 4,465,221 | A | 8/1984 | Schmidt |
| 4,481,016 | A | 11/1984 | Campbell et al. |
| 4,484,644 | A | 11/1984 | Cook et al. |
| 4,484,783 | A | 11/1984 | Emmerich |
| 4,489,986 | A | 12/1984 | Dziak |
| 4,499,795 | A | 2/1985 | Radtke |
| 4,525,178 | A | 6/1985 | Hall |
| 4,531,592 | A | 7/1985 | Hayatdavoudi |
| 4,535,853 | A | 8/1985 | Ippolito et al. |
| 4,538,691 | A | 9/1985 | Dennis |
| 4,566,545 | A | 1/1986 | Story et al. |
| 4,574,895 | A | 3/1986 | Dolezal et al. |
| 4,599,731 | A | 7/1986 | Ware et al. |
| 4,604,106 | A | 8/1986 | Hall |
| 4,627,503 | A | 12/1986 | Horton |
| 4,636,253 | A | 1/1987 | Nakai et al. |
| 4,636,353 | A | 1/1987 | Seon |
| 4,640,374 | A | 2/1987 | Dennis |
| 4,647,111 | A | 3/1987 | Bronder et al. |
| 4,647,546 | A | 3/1987 | Hall, Jr. et al. |
| 4,650,776 | A | 3/1987 | Cerceau et al. |
| 4,662,348 | A | 5/1987 | Hall et al. |
| 4,664,705 | A | 5/1987 | Horton et al. |
| 4,678,237 | A | 7/1987 | Collin |
| 4,682,987 | A | 7/1987 | Brady et al. |
| 4,684,176 | A | 8/1987 | Den Besten et al. |
| 4,688,856 | A | 8/1987 | Elfgen |
| 4,690,691 | A | 9/1987 | Komanduri |
| 4,694,918 | A | 9/1987 | Hall |
| 4,725,098 | A | 2/1988 | Beach |
| 4,726,718 | A | 2/1988 | Meskin et al. |
| 4,729,440 | A | 3/1988 | Hall |
| 4,729,603 | A | 3/1988 | Elfgen |
| 4,765,686 | A | 8/1988 | Adams |
| 4,765,687 | A | 8/1988 | Parrott |
| 4,776,862 | A | 10/1988 | Wiand |
| 4,852,672 | A | 8/1989 | Behrens |
| 4,880,154 | A | 11/1989 | Tank |
| 4,889,017 | A | 12/1989 | Fuller et al. |
| D305,871 | S | 2/1990 | Geiger |
| 4,932,723 | A | 6/1990 | Mills |
| 4,940,099 | A | 7/1990 | Deane et al. |
| 4,940,288 | A | 7/1990 | Stiffler et al. |
| 4,944,559 | A | 7/1990 | Sionnet et al. |
| 4,944,772 | A | 7/1990 | Cho |
| 4,951,762 | A | 8/1990 | Lundell |
| 4,956,238 | A | 9/1990 | Griffin |
| 4,962,822 | A | 10/1990 | Pascale |

4,981,184 A 1/1991 Knowlton et al.
5,007,685 A 4/1991 Beach et al.
5,009,273 A 4/1991 Grabinski
5,011,515 A 4/1991 Frushour
5,027,914 A 7/1991 Wilson
5,038,873 A 8/1991 Jurgens
D324,056 S 2/1992 Frazee
D324,226 S 2/1992 Frazee
5,088,797 A 2/1992 O'Neill
5,112,165 A 5/1992 Hedlund et al.
5,119,714 A * 6/1992 Scott et al. ..... 76/108.2
5,119,892 A 6/1992 Clegg et al.
5,141,063 A 8/1992 Quesenbury
5,141,289 A 8/1992 Stiffler
D329,809 S 9/1992 Bloomfield
5,154,245 A 10/1992 Waldenstrom
5,186,268 A 2/1993 Clegg
5,186,892 A 2/1993 Pope
5,222,566 A 6/1993 Taylor
5,248,006 A 9/1993 Scott et al.
5,251,964 A 10/1993 Ojanen
5,255,749 A 10/1993 Bumpurs et al.
5,261,499 A 11/1993 Grubb
5,265,682 A 11/1993 Russell et al.
D342,268 S 12/1993 Meyer
5,303,984 A 4/1994 Ojanen
5,304,342 A 4/1994 Hall, Jr. et al.
5,332,348 A 7/1994 Lemelson
5,351,770 A 10/1994 Cawthorne et al.
5,361,859 A 11/1994 Tibbitts
5,374,319 A 12/1994 Stueber et al.
D357,485 S 4/1995 Mattsson et al.
5,410,303 A 4/1995 Comeau et al.
5,417,292 A 5/1995 Polakoff
5,417,475 A 5/1995 Graham et al.
5,423,389 A 6/1995 Warren et al.
5,447,208 A 9/1995 Lund
5,494,477 A 2/1996 Flood et al.
5,507,357 A 4/1996 Hult et al.
D371,374 S 7/1996 Fischer et al.
5,533,582 A 7/1996 Tibbitts
5,535,839 A 7/1996 Brady
5,542,993 A 8/1996 Rabinkin
5,544,713 A 8/1996 Dennis
5,560,440 A 10/1996 Tibbitts
5,568,838 A 10/1996 Struthers et al.
5,653,300 A 8/1997 Lund
5,655,614 A 8/1997 Azar
5,662,720 A 9/1997 O'Tigheamaigh
5,678,644 A 10/1997 Fielder
5,709,279 A 1/1998 Dennis
5,720,528 A 2/1998 Ritchey
5,732,784 A 3/1998 Nelson
5,738,698 A 4/1998 Kapoor et al.
5,794,728 A 8/1998 Palmberg
5,811,944 A 9/1998 Sampayan et al.
5,823,632 A 10/1998 Burkett
5,837,071 A 11/1998 Andersson et al.
5,845,547 A 12/1998 Sollami
5,848,657 A 12/1998 Flood et al.
5,875,862 A 3/1999 Jurewicz
5,884,979 A 3/1999 Latham
5,890,552 A 4/1999 Scott et al.
5,896,938 A 4/1999 Moeny et al.
5,914,055 A 6/1999 Roberts et al.
5,934,542 A 8/1999 Nakamura et al.
5,935,718 A 8/1999 Demo et al.
5,944,129 A 8/1999 Jensen
5,947,215 A 9/1999 Lundell
5,950,743 A 9/1999 Cox
5,957,223 A 9/1999 Doster et al.
5,957,225 A 9/1999 Sinor
5,967,247 A 10/1999 Pessier
5,967,250 A 10/1999 Lund
5,979,571 A 11/1999 Scott et al.
5,992,405 A 11/1999 Sollami
5,992,547 A 11/1999 Caraway et al.
5,992,548 A 11/1999 Silva et al.
6,000,483 A 12/1999 Jurewicz et al.
6,003,623 A 12/1999 Miess
6,006,846 A 12/1999 Tibbitts et al.
6,018,729 A 1/2000 Zacharia et al.
6,019,434 A 2/2000 Emmerich
6,021,859 A 2/2000 Tibbitts et al.
6,039,131 A 3/2000 Beaton
6,041,875 A 3/2000 Rai et al.
6,044,920 A 4/2000 Massa et al.
6,051,079 A 4/2000 Andersson et al.
6,056,911 A 5/2000 Griffin
6,065,552 A 5/2000 Scott et al.
6,068,913 A 5/2000 Cho et al.
6,098,730 A 8/2000 Scott et al.
6,113,195 A 9/2000 Mercier et al.
6,131,675 A 10/2000 Anderson
6,150,822 A 11/2000 Hong et al.
6,170,917 B1 1/2001 Heinrich et al.
6,186,251 B1 2/2001 Butcher
6,193,770 B1 2/2001 Sung
6,196,340 B1 3/2001 Jensen
6,196,636 B1 3/2001 Mills
6,196,910 B1 3/2001 Johnson
6,199,645 B1 3/2001 Anderson et al.
6,199,956 B1 3/2001 Kammerer
6,202,761 B1 3/2001 Forney
6,213,226 B1 4/2001 Eppink et al.
6,216,805 B1 4/2001 Lays et al.
6,220,375 B1 4/2001 Butcher et al.
6,220,376 B1 4/2001 Lundell
6,223,824 B1 5/2001 Moyes
6,223,974 B1 5/2001 Unde
6,257,673 B1 7/2001 Markham et al.
6,258,139 B1 7/2001 Jensen
6,260,639 B1 7/2001 Yong et al.
6,269,893 B1 8/2001 Beaton et al.
6,270,165 B1 8/2001 Peay
6,272,748 B1 8/2001 Smyth
6,290,008 B1 9/2001 Portwood et al.
6,296,069 B1 10/2001 Lamine et al.
6,302,224 B1 10/2001 Sherwood, Jr.
6,302,225 B1 10/2001 Yoshida et al.
6,315,065 B1 11/2001 Yong et al.
6,332,503 B1 12/2001 Pessier et al.
6,340,064 B2 1/2002 Fielder et al.
6,341,823 B1 1/2002 Sollami
6,354,771 B1 3/2002 Bauschulte et al.
6,364,034 B1 4/2002 Schoeffler
6,364,420 B1 4/2002 Sollami
6,371,567 B1 4/2002 Sollami
6,375,272 B1 4/2002 Ojanen
6,375,706 B2 4/2002 Kembaiyan et al.
6,394,200 B1 5/2002 Watson et al.
6,408,052 B1 6/2002 McGeoch
6,408,959 B2 6/2002 Bertagnolli et al.
6,419,278 B1 7/2002 Cunningham
6,429,398 B1 8/2002 Legoupil et al.
6,439,326 B1 8/2002 Huang et al.
6,460,637 B1 10/2002 Siracki et al.
6,468,368 B1 10/2002 Merrick et al.
6,474,425 B1 11/2002 Truax et al.
6,478,383 B1 11/2002 Ojanen et al.
6,481,803 B2 11/2002 Ritchey
6,484,825 B2 11/2002 Watson et al.
6,484,826 B1 11/2002 Anderson et al.
6,499,547 B2 12/2002 Scott et al.
6,508,318 B1 1/2003 Linden et al.
6,510,906 B1 1/2003 Richert et al.
6,513,606 B1 2/2003 Krueger
6,517,902 B2 2/2003 Drake et al.
6,533,050 B2 3/2003 Molloy
6,561,293 B2 5/2003 Minikus et al.
6,562,462 B2 5/2003 Griffin et al.
D477,225 S 7/2003 Pinnavaia
6,585,326 B2 7/2003 Sollami
6,592,985 B2 7/2003 Griffin et al.
6,594,881 B2 7/2003 Tibbitts
6,596,225 B1 7/2003 Pope et al.
6,601,454 B1 8/2003 Botnan
6,601,662 B2 8/2003 Matthias et al.

| | | | |
|---|---|---|---|
| 6,622,803 | B2 | 9/2003 | Harvey |
| 6,668,949 | B1 | 12/2003 | Rives |
| 6,672,406 | B2 | 1/2004 | Beuershausen |
| 6,685,273 | B1 | 2/2004 | Sollami |
| 6,692,083 | B2 | 2/2004 | Latham |
| 6,702,393 | B2 | 3/2004 | Mercier |
| 6,709,065 | B2 | 3/2004 | Peay et al. |
| 6,711,060 | B2 | 3/2004 | Sakakibara |
| 6,719,074 | B2 | 4/2004 | Tsuda et al. |
| 6,729,420 | B2 | 5/2004 | Mensa-Wilmot |
| 6,732,817 | B2 | 5/2004 | Dewey et al. |
| 6,732,914 | B2 | 5/2004 | Cadden et al. |
| 6,733,087 | B2 | 5/2004 | Hall et al. |
| 6,739,327 | B2 | 5/2004 | Sollami |
| 6,758,530 | B2 | 7/2004 | Sollami |
| D494,031 | S | 8/2004 | Moore, Jr. |
| D494,064 | S | 8/2004 | Hook |
| 6,786,557 | B2 | 9/2004 | Montgomery, Jr. |
| 6,802,676 | B2 | 10/2004 | Noggle |
| 6,822,579 | B2 | 11/2004 | Goswami et al. |
| 6,824,225 | B2 | 11/2004 | Stiffler |
| 6,846,045 | B2 | 1/2005 | Sollami |
| 6,851,758 | B2 | 2/2005 | Beach |
| 6,854,810 | B2 | 2/2005 | Montgomery, Jr. |
| 6,861,137 | B2 | 3/2005 | Griffin et al. |
| 6,878,447 | B2 | 4/2005 | Griffin |
| 6,880,744 | B2 | 4/2005 | Noro et al. |
| 6,889,890 | B2 | 5/2005 | Yamazaki et al. |
| 6,929,076 | B2 | 8/2005 | Fanuel et al. |
| 6,933,049 | B2 | 8/2005 | Wan et al. |
| 6,953,096 | B2 | 10/2005 | Gledhill et al. |
| 6,959,765 | B2 | 11/2005 | Bell |
| 6,962,395 | B2 | 11/2005 | Mouthaan |
| 6,966,611 | B1 | 11/2005 | Sollami |
| 6,994,404 | B1 | 2/2006 | Sollami |
| 7,048,081 | B2 | 5/2006 | Smith et al. |
| 7,204,560 | B2 | 4/2007 | Mercier et al. |
| D547,652 | S | 7/2007 | Kerman et al. |
| D560,699 | S | 1/2008 | Omi |
| 7,380,888 | B2 | 6/2008 | Ojanen |
| 7,396,086 | B1 | 7/2008 | Hall et al. |
| 7,575,425 | B2 | 8/2009 | Hall et al. |
| 7,592,077 | B2 | 9/2009 | Gates, Jr. et al. |
| 7,665,552 | B2 | 2/2010 | Hall |
| 7,730,977 | B2 | 6/2010 | Achilles |
| 7,798,258 | B2 | 9/2010 | Singh et al. |
| 2001/0004946 | A1 | 6/2001 | Jensen |
| 2002/0074851 | A1 | 6/2002 | Montgomery, Jr. |
| 2002/0153175 | A1 | 10/2002 | Ojanen |
| 2002/0175555 | A1 | 11/2002 | Mercier |
| 2003/0079565 | A1 | 5/2003 | Liang et al. |
| 2003/0141350 | A1 | 7/2003 | Noro et al. |
| 2003/0209366 | A1 | 11/2003 | McAlvain |
| 2003/0213621 | A1 | 11/2003 | Britten |
| 2003/0217869 | A1 | 11/2003 | Snyder et al. |
| 2003/0234280 | A1 | 12/2003 | Cadden et al. |
| 2004/0026132 | A1 | 2/2004 | Hall |
| 2004/0026983 | A1 | 2/2004 | McAlvain |
| 2004/0065484 | A1 | 4/2004 | McAlvain |
| 2004/0155096 | A1 | 8/2004 | Zimmerman et al. |
| 2004/0238221 | A1 | 12/2004 | Runia et al. |
| 2004/0256155 | A1 | 12/2004 | Kriesels |
| 2004/0256442 | A1 | 12/2004 | Gates, Jr. |
| 2005/0044800 | A1 | 3/2005 | Hall |
| 2005/0159840 | A1 | 7/2005 | Lin et al. |
| 2005/0173966 | A1 | 8/2005 | Mouthaan |
| 2005/0263327 | A1 | 12/2005 | Meiners et al. |
| 2006/0060391 | A1 | 3/2006 | Eyre et al. |
| 2006/0086537 | A1 | 4/2006 | Dennis |
| 2006/0086540 | A1* | 4/2006 | Griffin et al. ..... 175/428 |
| 2006/0162969 | A1* | 7/2006 | Belnap et al. ..... 175/433 |
| 2006/0180354 | A1 | 8/2006 | Belnap et al. |
| 2006/0186724 | A1 | 8/2006 | Stehney |
| 2006/0237236 | A1 | 10/2006 | Sreshta et al. |
| 2007/0193782 | A1 | 8/2007 | Fang |
| 2007/0278017 | A1 | 12/2007 | Shen et al. |
| 2008/0006448 | A1 | 1/2008 | Zhang et al. |
| 2008/0053710 | A1 | 3/2008 | Moss |
| 2008/0073126 | A1 | 3/2008 | Shen et al. |
| 2008/0073127 | A1 | 3/2008 | Zhan et al. |
| 2008/0142276 | A1 | 6/2008 | Griffo et al. |
| 2008/0156544 | A1 | 7/2008 | Singh et al. |
| 2008/0206576 | A1 | 8/2008 | Qian et al. |

FOREIGN PATENT DOCUMENTS

| | | |
|---|---|---|
| DE | 3 500 261 | 7/1986 |
| DE | 3 818 213 | 11/1989 |
| DE | 4 039 217 | 6/1992 |
| DE | 19 821 147 | 11/1999 |
| DE | 10 163 717 | 5/2003 |
| EP | 0 295 151 | 6/1988 |
| EP | 0 412 287 | 2/1991 |
| GB | 2 004 315 | 3/1979 |
| GB | 2 037 223 | 7/1980 |
| JP | 5 280 273 | 10/1993 |

OTHER PUBLICATIONS

Chaturvedi et al., Diffusion Brazing of Cast Inconel 738 Superalloy, Sep. 2005, Journal of Materials Online.

International Report on Patentability Chapter I for PCT/US07/75670, mailed Nov. 17, 2008 (6 pages).

International Preliminary Report on Patentability Chapter II for PCT/US07/75670, completed Aug. 24, 2009 (4 pages).

* cited by examiner

THERMALLY STABLE POINTED DIAMOND WITH INCREASED IMPACT RESISTANCE

This application is a continuation-in-part of U.S. patent application Ser. No. 12/051,738 filed on Mar. 19, 2008 and that issued as U.S. Pat. No. 7,669,674 on Mar. 2, 2010, which is a continuation of U.S. patent application Ser. No. 12/051,689 filed on Mar. 19, 2008 and that issued as U.S. Pat. No. 7,963,617 on Jun. 11, 2011, which is a continuation of U.S. patent application Ser. No. 12/051,586 filed on Mar. 19, 2008 and that issued as U.S. Pat. No. 8,007,050 on Aug. 30, 2011, which is a continuation-in-part of U.S. patent application Ser. No. 12/021,051 filed on Jan. 28, 2008 now U.S. Pat. No. 8,123,302, which is a continuation-in-part of U.S. patent application Ser. No. 12/021,019 filed on Jan. 28, 2008, which was a continuation-in-part of U.S. patent application Ser. No. 11/971,965 filed on Jan. 10, 2008 and that issued as U.S. Pat. No. 7,648,210, which is a continuation of U.S. patent application Ser. No. 11/947,644 filed on Nov. 29, 2007 and that issued as U.S. Pat. No. 8,007,051 on Aug. 30, 2011, which is a continuation-in-part of U.S. patent application Ser. No. 11/844,586 filed on Aug. 24, 2007 and that issued as U.S. Pat. No. 7,600,823 on Oct. 13, 2009, which is a continuation-in-part of U.S. patent application Ser. No. 11/829,761 filed Jul. 27, 2007 and that issued as U.S. Pat. No. 7,722,127 on May 25, 2010, which is a continuation-in-part of U.S. patent application Ser. No. 11/773,271 filed on Jul. 3, 2007 and that issued as U.S. Pat. No. 7,997,661 on Aug. 16, 2011, which is a continuation-in-part of U.S. patent application Ser. No. 11/766,903 filed on Jun. 22, 2007, which is a continuation of U.S. patent application Ser. No. 11/766,865 filed on Jun. 22, 2007, which is a continuation-in-part of U.S. patent application Ser. No. 11/742,304 filed Apr. 30, 2007 and that issued as U.S. Pat. No. 7,475,948 on Jan. 13, 2008, which is a continuation of U.S. patent application Ser. No. 11/742,261 filed on Apr. 30, 2007 and that issued as U.S. Pat. No. 7,469,971, which is a continuation-in-part of U.S. patent application Ser. No. 11/464,008 filed on Aug. 11, 2006 and that issued as U.S. Pat. No. 7,338,135 on Mar. 8, 2008, which is a continuation-in-part of U.S. patent application Ser. No. 11/463,998 filed on Aug. 11, 2006 and that issued as U.S. Pat. No. 7,384,105 on Jun. 10, 2008, which is a continuation-in-part of U.S. patent application Ser. No. 11/463,990 filed on Aug. 11, 2006 and that issued as U.S. Pat. No. 7,320,505 on Jan. 22, 2008, which is a continuation-in-part of U.S. patent application Ser. No. 11/463,975 filed on Aug. 11, 2006 and that issued as U.S. Pat. No. 7,445,294 on Nov. 4, 2008, which is a continuation-in-part of U.S. patent application Ser. No. 11/463,962 filed on Aug. 11, 2006 and that issued as U.S. Pat. No. 7,413,256 on Aug. 19, 2008. This application is also a continuation-in-part of U.S. patent application Ser. No. 11/673,634 filed on Feb. 12, 2007, now U.S. Pat. No. 8,109,349. All of these applications are herein incorporated by reference for all that they contain.

BACKGROUND OF THE INVENTION

This invention generally relates to diamond bonded materials and, more specifically, diamond bonded materials and inserts formed therefrom that are specifically designed to provide improved thermal stability when compared to conventional polycrystalline diamond materials.

U.S. Pat. No. 263,328 to Middlemiss, which is herein incorporated by U.S. Patent Application Publication No. 2005/0263328 to Middlemiss, which is herein incorporated by reference for all it contains, discloses a thermally stable region having a microstructure comprising a plurality of diamond grains bonded together by a reaction with a reactant material. The PCD region extends from the thermally stable region and has a microstructure of bonded together diamond grains and a metal solvent catalyst disposed interstitially between the bonded diamond grains. The compact is formed by subjecting the diamond grains, reactant material, and metal solvent catalyst to a first temperature and pressure condition to form the thermally stable region, and then to a second higher temperature condition to form both the PCD region and bond the body to a desired substrate.

U.S. Patent Application Publication No. 2006/0266559 to Keshavan et al., which is herein incorporated by reference for all that it contains, discloses a diamond body having bonded diamond crystals and interstitial regions disposed among the crystals. The diamond body is formed from diamond grains and a catalyst material at high-pressure/high-temperature conditions. The diamond grains have an average particle size of about 0.03 mm or greater. At least a portion of the diamond body has a high diamond volume content of greater than about 93 percent by volume. The entire diamond body can comprise the high volume content diamond or a region of the diamond body can comprise the high volume content diamond. The diamond body includes a working surface, a first region substantially free of the catalyst material. At least a portion of the first region extends from the working surface to depth of from about 0.01 to about 0.1 mm.

U.S. Pat. No. 7,473,287 to Belnap et al., which is herein incorporated by reference for all that it contains, discloses a thermally-stable polycrystalline diamond materials comprising a first phase including a plurality of bonded together diamond crystals, and a second phase including a reaction product formed between a binder/catalyst material and a material reactive with the binder/catalyst material. The reaction product is disposed within interstitial regions of the polycrystalline diamond material that exists between the bonded diamond crystals. The first and second phases are formed during a single high pressure/high temperature process condition. The reaction product has a coefficient of thermal expansion that is relatively closer to that of the bonded together diamond crystals than that of the binder/catalyst material, thereby providing an improved degree of thermal stability to the polycrystalline diamond material.

U.S. Pat. No. 6,562,462 to Griffin, which is herein incorporated by reference for all that it contains, discloses a polycrystalline diamond or diamond-like element with greatly improved wear resistance without loss of impact strength. These elements are formed with a binder-catalyzing material in a high-temperature/high-pressure (HTHP) process. The PCD element has a body with a plurality of bonded diamond or diamond-like crystals forming a continuous diamond matrix that has a diamond volume density greater than 85%. Interstices among the diamond crystals form a continuous interstitial matrix containing a catalyzing material. The diamond matrix table is formed and integrally bonded with a metallic substrate containing the catalyzing material during the HTHP process. The diamond matrix body has a working surface, where a portion of the interstitial matrix in the body adjacent to the working surface is substantially free of the catalyzing material, and the remaining interstitial matrix contains the catalyzing material. Typically, less than about 70% of the body of the diamond matrix table is free of the catalyzing material.

BRIEF SUMMARY OF THE INVENTION

In one aspect of the invention, an insert comprises a sintered polycrystalline diamond body bonded to a cemented metal carbide substrate. The diamond body comprises a substantially conical shape with conical side wall terminating at an apex. The diamond body comprises a first region with a metallic catalyst dispersed through interstices between the diamond grains and a second region proximate the apex with the characteristic of higher thermal stability than the first region.

The second region may comprise a natural diamond. The natural diamond may form the apex. The natural diamond may be covered by a small layer of the diamond and metallic catalyst found in the first region. The metallic catalyst in the small layer may be mixed with the diamond grains prior to sintering. The metallic catalyst in the small layer may diffuse from the substrate during sintering. The second region may comprise a sintered natural diamond, a single crystal natural diamond, a single crystal synthetic diamond, or combinations thereof. The second region may comprise a coarse saw grade diamond. The second region may comprise cubic boron nitride. The second region may comprise an asymmetrical shape. The second region may comprise a non-metallic catalyst. The second region may be pre-sintered prior to being sintered with the first region. The second region may comprise fully dense diamond, which was processed in high enough pressure to not need a catalyst.

The pre-sintered second region may be leached prior to being re-sintered with the first region. The diamond body may be thicker than the substrate. The diamond body may comprise a conical side wall that forms a 40 to 50 degree angle with a central axis of the insert. The first region may separate the second region from the substrate. The second region may be substantially free of the metallic catalyst. The different portions of the polycrystalline diamond body may comprise different volumes of the metallic catalyst. The first and the second regions may be joined at a non-planar interface.

In another aspect of the invention, a method of forming an insert may comprise the steps of placing diamond powder in a conical metallic carbide can, compressing the carbide can under a high-pressure/high-temperature such that the powder forms a pointed sintered compact, removing the metallic catalyst from the sintered compact, and re-sintering the pointed sintered compact to another sintered diamond body such that the pointed sintered compact forms a tip.

DETAILED DESCRIPTION OF THE INVENTION AND THE PREFERRED EMBODIMENT

Figure 1:
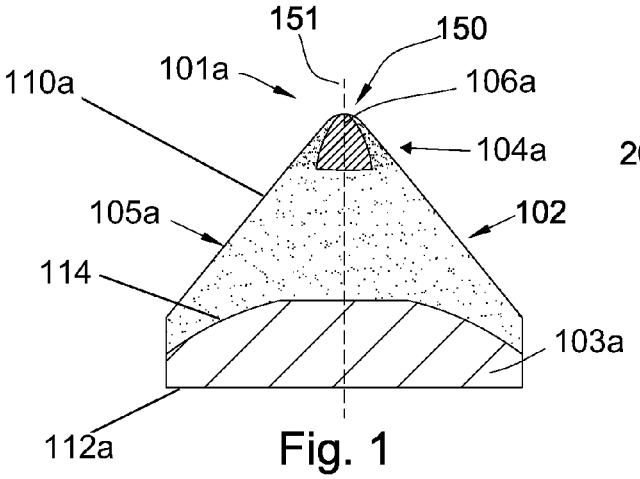
FIG. 1 is a cross-sectional diagram of an embodiment of an insert.

FIG. 1 is a cross-sectional diagram of an embodiment of an insert 101*a* comprising a diamond bonded body 102 and a cemented metal carbide substrate 103*a*. The diamond body 102 may comprise a substantially conical shape with conical side wall 110*a* terminating at an apex 150. The diamond body 102 may comprise a first region 105*a* with a metallic catalyst dispersed through interstices between the diamond grains and a second region 104*a* proximate the apex 150 and having the characteristic of higher thermal stability than the first region 105*a*. The conical side wall 110*a* may form a 40 to 50 degree angle with a central axis 151 of the insert 101*a*. In the preferred embodiment, the first region 105*a* separates the second region 104*a* from the cemented metal carbide substrate 103*a*. In some embodiments, the cemented metal carbide substrate 103*a* comprises an interface 112*a* adapted for brazing to another object, such as a bit, a pick, a shank, a face, or combinations thereof. In some embodiments, the cemented metal carbide substrate 103*a* will comprise a diameter with a long enough length for press fitting into a pocket of another object.

In a preferred embodiment, the diamond regions are thicker than the cemented metal carbide substrate 103*a*. The diamond regions also preferably comprise a greater volume than the cemented metal carbide substrate 103*a*. The apex 150 of the overall diamond structure may be rounded, with a 0.050 to 0.150 inch radius. Such a radius is sharp enough to penetrate the hard formations such as granite, while, with the combination of the angle of the conical side wall 110*a*, buttress the apex 150 under high loads. In many applications, the apex 150 will be subject to the most abuse, thus experiencing the highest wear and greatest temperatures.

Most attempts of the prior art to make diamond thermally stable have resulted in weakened impact strength. Some prior art references teach that their structure simply does not compromise the impact strength of their part (see Griffin cited in the background). The present invention, not only improves the thermal stability of the entire tool, but its shape actually increases its impact strength as well.

To achieve both the increased impact strength and thermal stability, the diamond of the first region 105*a* must be at least 0.100 inches, but no more than 0.275 inches, preferably about 0.150 inches from the apex 150 to the non-planar interface 114. This range is much thicker than what is typically commercial available at the time of this application's filing. It is believed that this critical range allows for the compressive forces to propagate through the diamond, and the radial expansion caused by that compression to be mostly accommodated in the cemented metal carbide substrate 103*a* below the first region 105*a* of diamond. This range solves a long standing problem in the art because generally parts enhanced with diamond have thin thicknesses, typically under 0.070 inches. In such cases with thin diamond, the point of impact on the diamond is supported by the carbide and will flex under high loads. The thick diamond on the other hand will not flex because its point of impact is supported by more diamond. However, under impacts not only does a section of a tool compress, but a section will also tend to expand radially as well. The critical range allows the radial expansion to occur in the carbide substrate which is much more flexible than the diamond. If the diamond were too thick, the diamond may be prone to cracking from the radial expansion forces because the diamond may be weaker in tension than the carbide.

Thus, the thermal stability near the apex 150 combined with the collective shape of the first region 105*a* and the second region 104*a* overcome a long standing need in the art by increasing both the thermal stability of the tool and increasing the impact strength.

Figure 3:
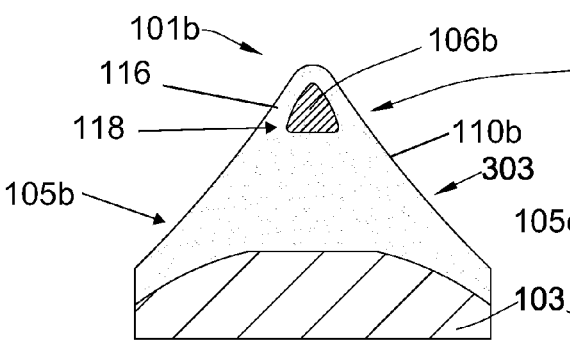
FIG. 3 is a cross-sectional diagram of another embodiment of an insert.

Several molecular structures may be used to create the thermally stable characteristic of the second region 104*a*. The second region 104*a* may comprise a natural diamond 106*a*. The natural diamond 106*a* may form the apex 150 as in FIG. 1, or the natural diamond 106*b* may be situated below a surface 116 of the diamond of a first region 105*b* as shown in FIG. 3. Because natural diamond 106*a* lacks a metallic binder, in high temperature conditions the natural diamond 106*a* is not subjected to differing thermal expansions, which leads to diamond failure in the field.

Another molecular structure that may achieve the high thermally stable characteristic is sintered polycrystalline diamond void of metallic binder in its interstices. The tips of the first region may be leached to remove the binder and, thus, form the thermally stable second region. In other embodiments, the second region may be sintered separately, leached and then attached to the first region. The attachment may be achieved through sintering the regions together, brazing, or other bonding methods.

Other molecular structures that may achieve the higher thermal stability include single crystal natural diamond, a single crystal synthetic diamond, coarse saw grade diamond, or combinations thereof. The average size of natural diamond crystal is 2.5 mm or more.

The second region 104*a* may comprise a cubic boron nitride, which generally exhibits a greater thermal stability than polycrystalline diamond comprising the metallic binder. The second region 104*a* may also comprise fully dense PCD grains sintered at extremely high temperature and pressure where catalysts are not used to promote diamond to diamond bonding.

In other embodiments, a non-metallic catalyst may be used in the second region 104*a* to achieve higher thermal stability. Such non-metallic catalysts may include silicon, silicon carbide, boron, carbonates, hydroxide, hydride, hydrate, phosphorus-oxide, phosphoric acid, carbonate, lanthanide, actinide, phosphate hydrate, hydrogen phosphate, phosphorus carbonate, or combinations thereof. In some cases, a chemical may be doped into the second region 104*a* to react with a metallic catalyst such that the catalyst no longer exhibits such drastic difference in thermal expansion as the diamond.

Figure 2:
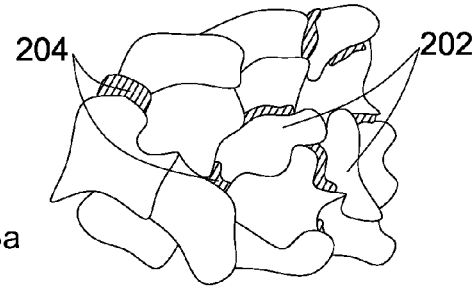
FIG. 2 is a diagram of an embodiment of a diamond region.

FIG. 2 is a diagram of an embodiment of the first region 105*a* of the insert 101*a* having a material microstructure comprising diamond crystal grains 202 and metallic binders 204. The diamond grains 202 are intergrown and bonded to one another as a result of the sintering process. The metallic binders 204 are disposed in the interstices or voids among the diamond grains 202. During sintering these metallic binders promote the diamond-to-diamond bonding. The metallic binder 204 may be selected from the group consisting of palladium, rhodium, tin, iron, manganese, nickel, selenium, cobalt, chromium, molybdenum, tungsten, titanium, zirconium, vanadium, niobium, tantalum, platinum, copper, silver, or combinations thereof. Under hot conditions, the metallic binder 204 will expand more than the diamond grain 202 and generate internal stress in the diamond. The stress is believed to be a significant factor to most diamond failure in downhole drilling applications.

FIG. 3 is a cross-section diagram of an embodiment of an insert 101*b* and discloses a sintered natural diamond 106*b* as a second region 104*b*. The sintered natural diamond 106*b* may be covered with a small layer 118 of polycrystalline diamond of the first region 105*b*. The surrounding diamond of the first region 105*b* may be bonded to the diamond of the second region 104*b* resulting in a strong attachment. The embodiment of FIG. 3 also discloses a substantially conical side wall 110*b* that comprises a slight concavity 303.

Figure 4:
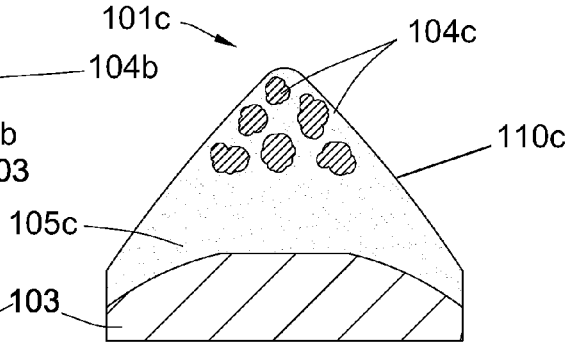
FIG. 4 is a cross-sectional diagram of another embodiment of an insert.

FIG. 4 is a cross-sectional diagram of an embodiment of an insert 101*c* and discloses a plurality of second regions 104*c* mixed in a first region 105*c*. In this embodiment, the second regions 104*c* are composed of natural diamonds. The average natural diamond size may be about 0.03 mm or more. The insert 101*c* may also comprise a slightly convex side wall 110*c*.

Figure 5:
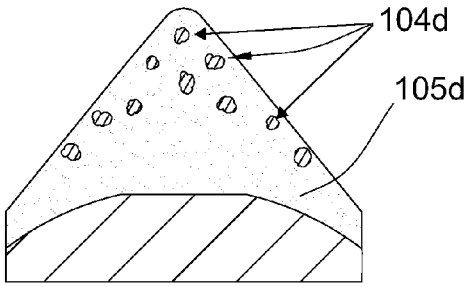
FIG. 5 is a cross-sectional diagram of another embodiment of an insert.

FIG. 5 is a cross-sectional diagram of an embodiment of an insert 101*d* and discloses additional second regions 104*d* that are dispersed through an upper portion of a first region 105*d*. As disclosed in the embodiment of insert 101*d* of FIG. 5, the second regions 104*d* may be dispersed through any area of the diamond that may come into contact with a formation during a cutting operation.

The second region 104*d* may also comprise boron doped into the interstices to react with metallic binders. The melting temperature of boron is very high. The second region 104*d* may also comprise boron doped into interstices where the metallic binder has already been removed.

Figure 6:
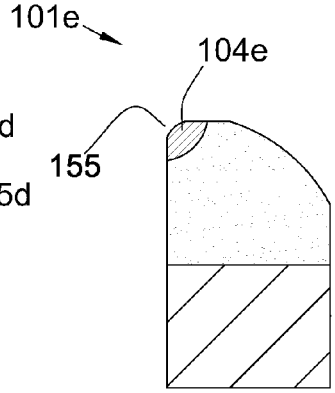
FIG. 6 is a cross-sectional diagram of another embodiment of an insert.

FIG. 6 is a cross-sectional diagram of an embodiment of an insert 101*e* with an off-center apex 155. In this embodiment of an insert 101*e*, a second region 104*e* of more thermally stable diamond forms the apex 155.

FIGS. 7-14 disclose different embodiments of non-planar interfaces that may be used between the first region and second region of the respective embodiments. In some embodiments, a planar interface (not shown) may be used. The non-planar interfaces may help interlock the first region and the second region together.

Figure 7:
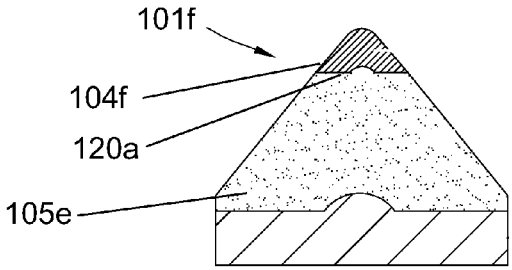
FIG. 7 is a cross-sectional diagram of another embodiment of an insert.

FIG. 7 is a cross-sectional diagram of an embodiment of an insert 101*f* with a first region 105*e* and a second region 104*f* and a non-planar interface 120*a*.

Figure 8:
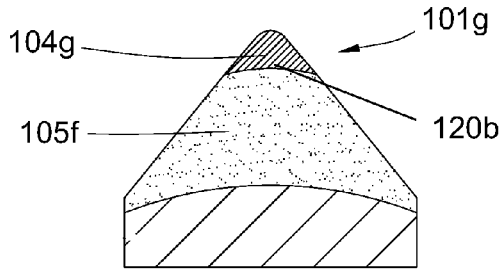
FIG. 8 is a cross-sectional diagram of another embodiment of an insert.

FIG. 8 is a cross-sectional diagram of an embodiment of an insert 101*g* with a first region 105*f* and a second region 104*g* and a non-planar interface 120*b*.

Figure 9:
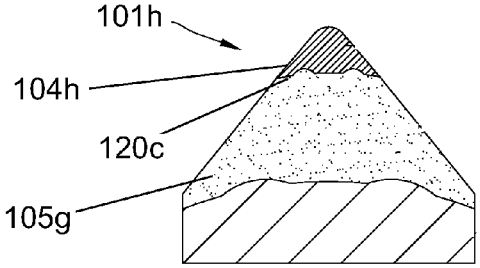
FIG. 9 is a cross-sectional diagram of another embodiment of an insert.

FIG. 9 is a cross-sectional diagram of an embodiment of an insert 101*h* with a first region 105*g* and a second region 104*h* and a non-planar interface 120*c*.

Figure 10:
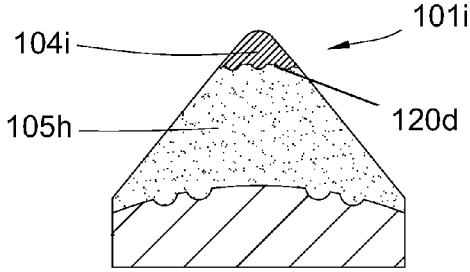
FIG. 10 is a cross-sectional diagram of another embodiment of an insert.

FIG. 10 is a cross-sectional diagram of an embodiment of an insert 101*i* with a first region 105*h* and a second region 104*i* and a non-planar interface 120*d*.

Figure 11:
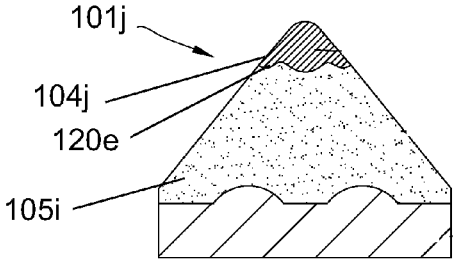
FIG. 11 is a cross-sectional diagram of another embodiment of an insert.

FIG. 11 is a cross-sectional diagram of an embodiment of an insert 101*j* with a first region 105*i* and a second region 10*j* and a non-planar interface 120*e*.

Figure 12:
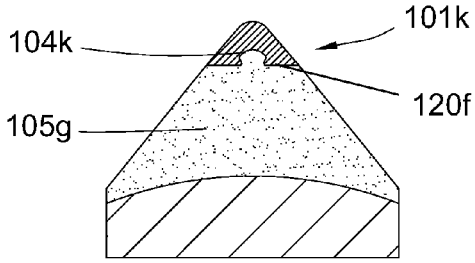
FIG. 12 is a cross-sectional diagram of another embodiment of an insert.

FIG. 12 is a cross-sectional diagram of an embodiment of an insert 101*k* with a first region 105*j* and a second region 104*k* and a non-planar interface 120*f*.

Figure 13:
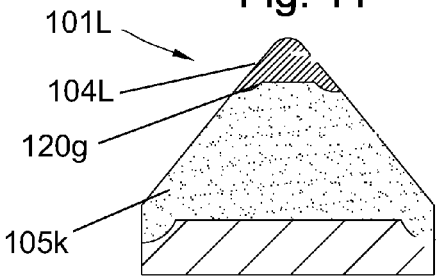
FIG. 13 is a cross-sectional diagram of another embodiment of an insert.

FIG. 13 is a cross-sectional diagram of an embodiment of an insert 101*l* with a first region 105*k* and a second region 104*l* and a non-planar interface 120*g*.

Figure 14:
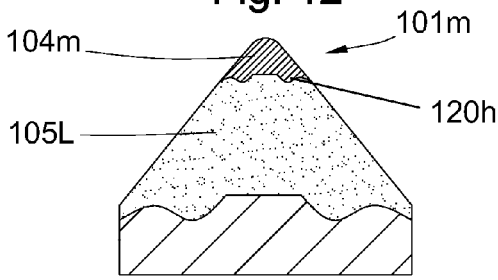
FIG. 14 is a cross-sectional diagram of another embodiment of an insert.

FIG. 14 is a cross-sectional diagram of an embodiment of an insert 101*m* with a first region 105*l* and a second region 104*m* and a non-planar interface 120*h*.

Figure 15:
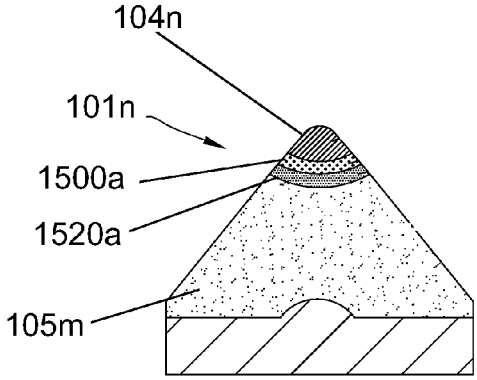
FIG. 15 is a cross-sectional diagram of another embodiment of an insert.

FIGS. 15-20 disclose inserts that have several regions layered over each other with non-planar interfaces. In FIG. 15, an insert 101*n* includes a third region 1500*a* and fourth region 1520*a* that may comprise diamond grains of different sizes and/or different binder concentrations than each other or the first or second regions. The second region 104*n* may comprise diamond grains of size 0-10 microns. The third region 1500*a* may comprise diamond grains of size 10-20 microns. The fourth region 1520*a* may comprise diamond grains of size 20-30 microns. The first region 105*m* may comprise diamond grains of size 10-40 microns.

Figure 16:
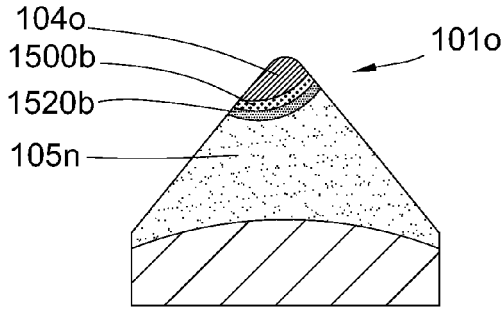
FIG. 16 is a cross-sectional diagram of another embodiment of an insert.

FIG. 16 is a cross-sectional diagram of an embodiment of an insert 1010 with a first region 105*n*, a second region 104*o*, a third region 1500*b*, and a fourth region 1520*b*.

Figure 17:
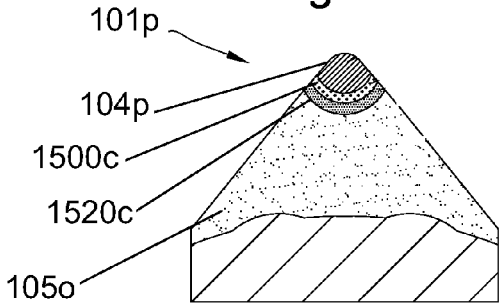
FIG. 17 is a cross-sectional diagram of another embodiment of an insert.

FIG. 17 is a cross-sectional diagram of an embodiment of an insert 101*p* with a first region 1050, a second region 104*p*, a third region 1500*c*, and a fourth region 1520*c*.

Figure 18:
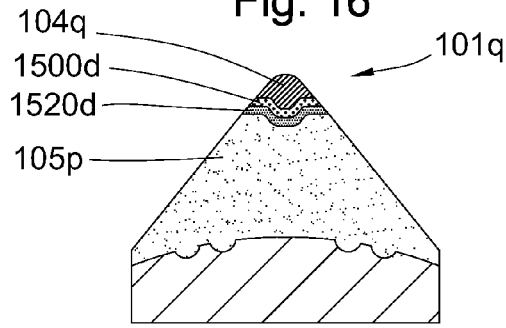
FIG. 18 is a cross-sectional diagram of another embodiment of an insert.

FIG. 18 is a cross-sectional diagram of an embodiment of an insert 101*q* with a first region 105*p*, a second region 104*q*, a third region 1500*d*, and a fourth region 1520*d*.

Figure 19:
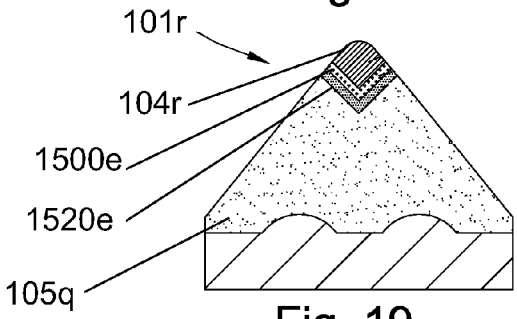
FIG. 19 is a cross-sectional diagram of another embodiment of an insert.

FIG. 19 is a cross-sectional diagram of an embodiment of an insert 101*r* with a first region 105*q*, a second region 104*r*, a third region 1500*e*, and a fourth region 1520*e*.

Figure 20:
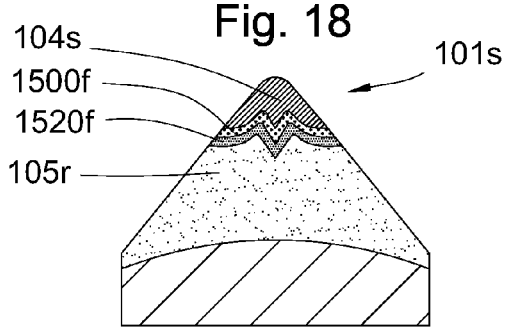
FIG. 20 is a cross-sectional diagram of another embodiment of an insert.

FIG. 20 is a cross-sectional diagram of an embodiment of an insert 101*s* with a first region 105*r*, a second region 104*s*, a third region 1500*f*, and a fourth region 1520*f*.

Figure 21A:
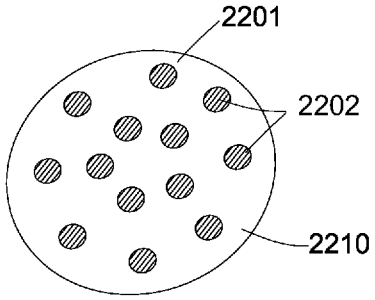
FIG. 21*a* is a top orthogonal diagram of a carbide disk comprising a number of tip molds.
Figure 21B:
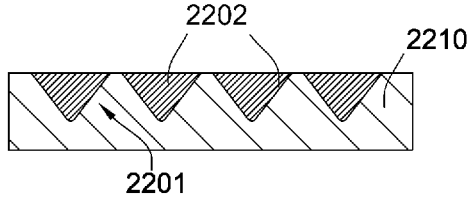
FIG. 21*b* is a cross-sectional diagram of an embodiment of a carbide disk.
Figure 21C:
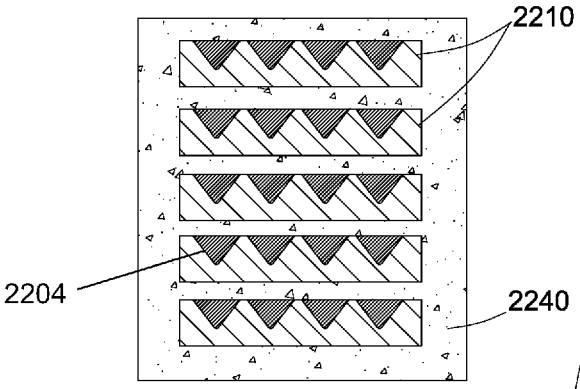
FIG. 21*c* is a cross-sectional diagram of an embodiment of a cube for HPHT processing comprising a plurality of carbide disks.
Figure 21D:
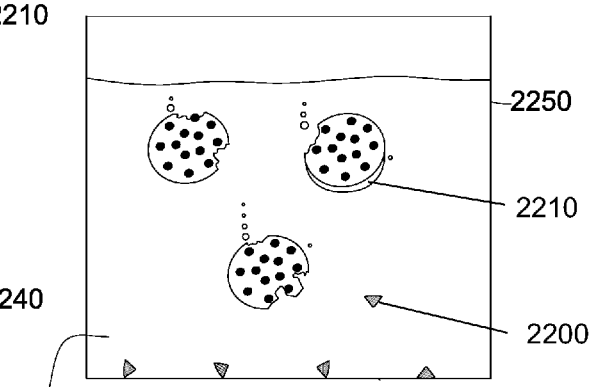
FIG. 21*d* is an orthogonal diagram of an embodiment of a leaching process.
Figure 21E:
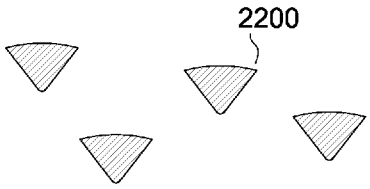
FIG. 21*e* is a cross-sectional diagram of an embodiment of a plurality of thermally stable diamond tips.
Figure 21F:
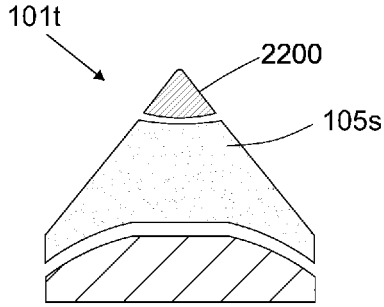
FIG. 21*f* is a cross-sectional diagram of another embodiment of an insert.

A method for manufacturing an embodiment of the invention is referred to in FIGS. 21*a-f*. Thermally stable diamond tips 2200 (FIG. 21*e* and FIG. 21*f*) may be made in a first sintering process. In FIGS. 21*a* and 21*b*, a carbide disc 2210 with a plurality of shaped cavities 2201 may form the molds for the eventual tips 2200. The cavities 2201 are filled with diamond powder 2202 and multiple discs 2210 are stacked together inside a cube 2240, as illustrated in FIG. 21*c*. The cube 2240 is loaded into a high-pressure/high-temperature press (note shown) and compressed by a plurality of opposing anvils while in a high temperature environment. A metal, usually cobalt, from the carbide discs 2210 diffuse into the diamond powder 2202 and act as a catalyst to promote the diamond-to-diamond bonding. The diffused metal remains in the interstices of the diamond tips 2204 after the sintering cycle is finished. In FIG. 21*d*, the metal may be removed from the sintered tips 2204 by putting the discs 2200 in a container 2250 filled with a leaching agent 2230. The leaching agent 2230 may be selected from the group consisting of toluene, xylene, acetone, an acid or alkali aqueous solution, and chlorinated hydrocarbons. Once the tips 2200 have been separated from the carbide discs 2210 and are leached, the leached tips 2200 may be attached to a first region 105*s* of an insert 101*t*. In a preferred method, the leached tips 2200 are loaded into a can first and then the can is back-filled with more diamond powder. The can is again assembled in a cube for high-temperature and high-pressure processing. In some embodiments, the carbide discs are removed through sand blasting.

Figure 22A:
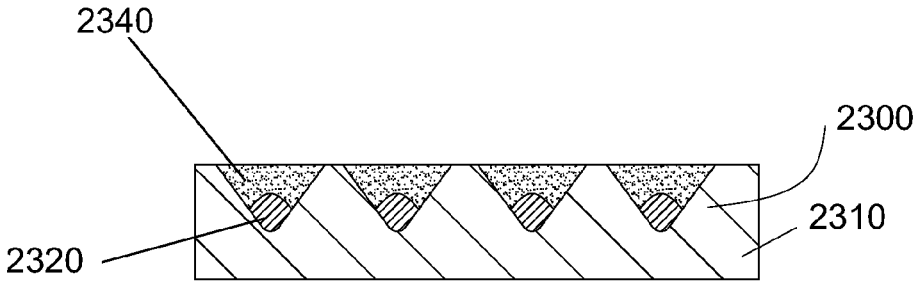
FIG. 22*a* is a cross-sectional diagram of another embodiment of a carbide disk.
Figure 22B:
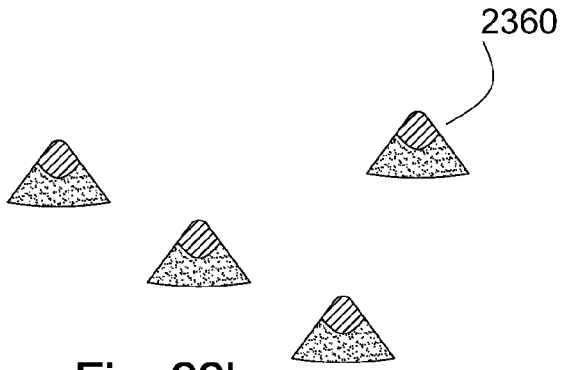
FIG. 22*b* is a cross-sectional diagram of another embodiment of a plurality of thermally stable diamond tips.
Figure 22C:
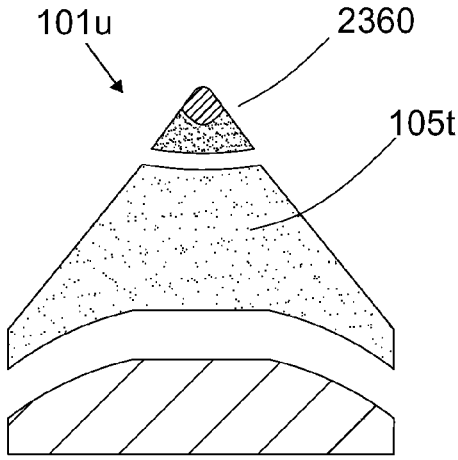
FIG. 22*c* is a perspective diamond of another embodiment of an insert.

FIGS. 22*a-c* disclose steps in another embodiment of a method for forming a second region of an insert. Cavities 2300 of a disc 2310 are filled with a large single crystal of diamond 2320 and back filled with a diamond powder 2340. The single crystal diamond 2320 may be synthetic or natural. During sintering, the single crystal diamond 2320 and the diamond powder 2340 may bond to one another forming a pointed sintered compact 2360 as shown in FIG. 22*b*. The pointed sintered compact 2360 may require grinding or sand blasting before re-sintering it with the rest of a first region 105*t* of an insert 101*u*.

Figure 23:
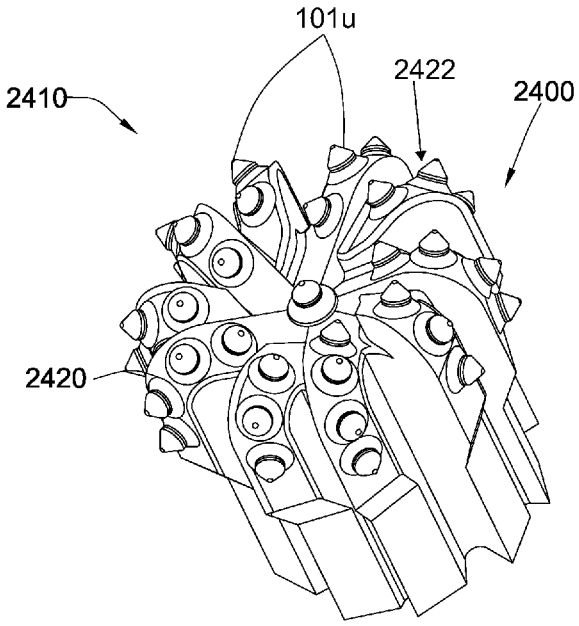
FIG. 23 is a perspective diagram of an embodiment of a rotary drag bit.

FIG. 23 is a perspective diagram of an embodiment of a rotary drag bit 2410 that may comprise inserts 101*u*. The rotary drag bit 2410 may comprise a plurality of blades 2400 formed in the working face 2420 of the drag bit 2410. The rotary drag bit 2410 may comprise at least one degradation assembly 2422 comprising the diamond bonded inserts 101*u*.

Figure 24:
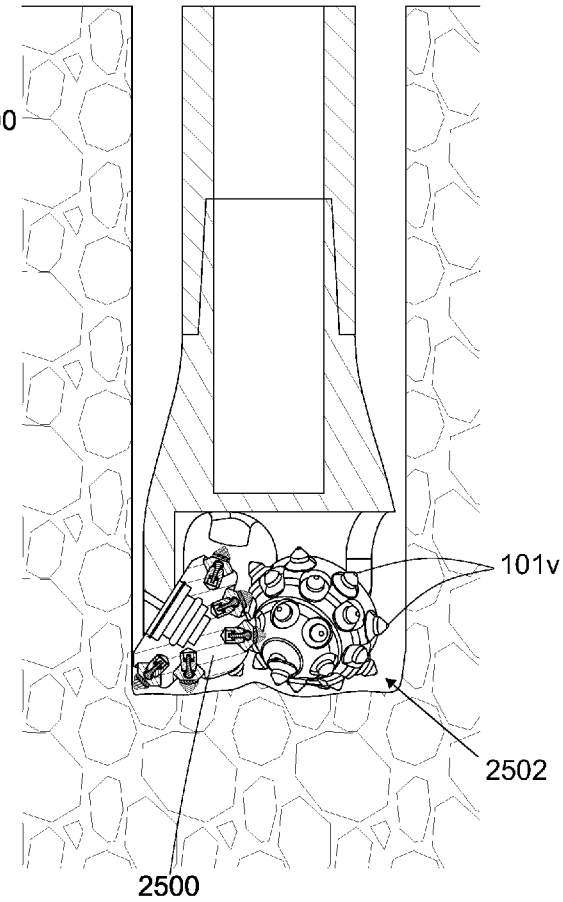
FIG. 24 is a cross-sectional diagram of an embodiment of a roller cone bit.

FIG. 24 is a cross-sectional diagram of an embodiment of a roller cone bit 2502 that may also incorporate an insert 101*v* as well, which may be bonded to the roller cones 2500.

Figure 25:
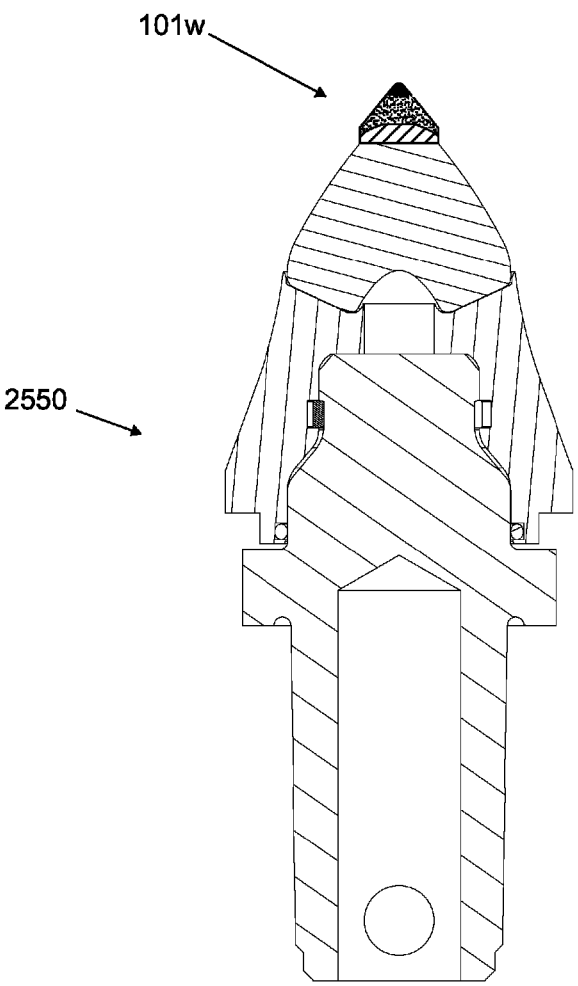
FIG. 25 is a cross-sectional diagram of an embodiment of a pick.
Figure 26:
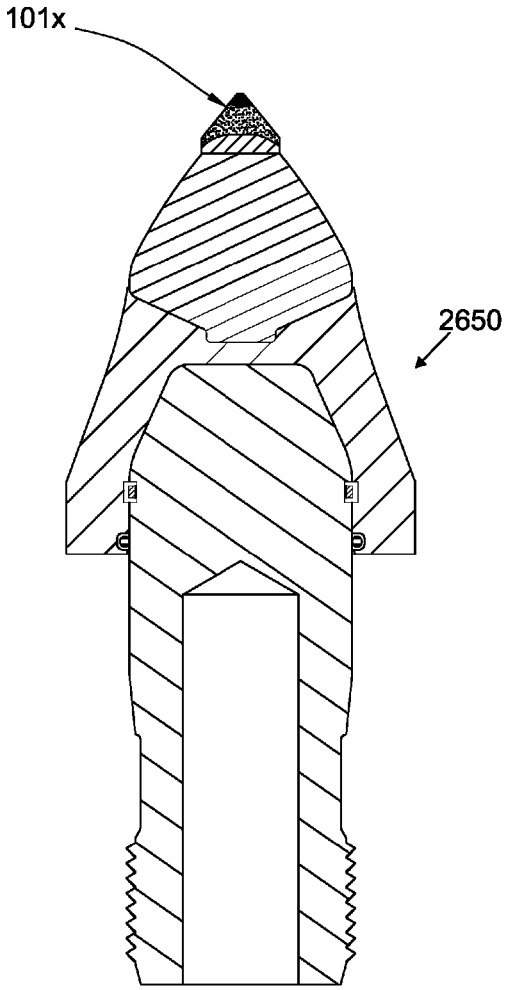
FIG. 26 is a cross-sectional diagram of another embodiment of a pick.

FIG. 25 is a cross-sectional diagram of an embodiment of a pick 2550 that may incorporate an insert 101*w*. FIG. 26 is across-sectional diagram of an embodiment of a pick 2650 that may incorporate an insert 101*x*. The picks 2550 and 2650 may be a milling pick, a mining pick, a pick, an excavation pick, a trenching pick or combinations thereof.

Whereas the present invention has been described in particular relation to the drawings attached hereto, it should be understood that other and further modifications apart from those shown or suggested herein, may be made within the scope and spirit of the present invention.

What is claimed is:

1. An insert, comprising:

a sintered polycrystalline diamond body bonded to a cemented metal carbide substrate, the sintered polycrystalline diamond body including:

an apex;

a substantially conical shape and a conical side wall terminating at the apex;

a first region between the cemented metal carbide substrate and the apex, the first region comprising a first characteristic thermal stability; and, a second region covered by a layer of the first region, the second region including:

a natural diamond; and, a second characteristic thermal stability higher than the first characteristic thermal stability.

2. The insert of claim 1, wherein the natural diamond forms the apex.

3. The insert of claim 1, wherein a thickness of the layer of the first region that covers the second region is less than a thickness of the first region.

4. The insert of claim 1, wherein the second region comprises at least one of a sintered natural diamond, a single crystal natural diamond, coarse saw grade diamond, cubic boron nitride, a non-metallic catalyst, and a single crystal synthetic diamond.

5. The insert of claim 1, wherein the sintered polycrystalline diamond body is thicker than the cemented metal carbide substrate.

6. The insert of claim 1, wherein the first region separates the second region from the cemented metal carbide substrate.

7. The insert of claim 1, wherein the second region is substantially free of a metallic catalyst.

8. The insert of claim 1, wherein first region and the second regions are joined at a non-planar interface.

9. A bit, comprising:

an insert having a sintered polycrystalline diamond body bonded to a cemented metal carbide substrate, the sintered polycrystalline diamond body including:

an apex;

a substantially conical shape and a conical side wall terminating at the apex;

a first region between the cemented metal carbide substrate and the apex, the first region having a metallic catalyst dispersed through interstices between diamond grains that form the polycrystalline diamond, the first region comprising a first characteristic thermal stability; and, a second region covered by a layer of the first region, the second region including:

a natural diamond; and, a second characteristic thermal stability higher than the first characteristic thermal stability.

10. The bit of claim 9, wherein the bit is at least one of a drill bit, a drag bit, a roller cone bit, and a percussion bit.

11. The bit of claim 9, wherein the insert is at least one of a milling pick, a mining pick, pick, an excavation pick, and a trenching pick.

* * * * *